United States Patent [19]

Gassaway

[11] 4,361,305

[45] Nov. 30, 1982

[54] SECURITY DEVICE FOR ROTATABLY MOUNTING AN ARTICLE TO A SURFACE

[76] Inventor: James S. Gassaway, 2356 Glendon Ave., Los Angeles, Calif. 90064

[21] Appl. No.: 113,672

[22] Filed: Jan. 21, 1980

[51] Int. Cl.[3] ..... E05B 73/00

[52] U.S. Cl. ..... 248/553; 70/232

[58] Field of Search ..... 248/551, 553; 70/231, 70/232, 428

[56] References Cited

U.S. PATENT DOCUMENTS

| | | | |
|---|---|---|---|
| 2,440,744 | 5/1948 | Grinnell et al. | 70/232 |
| 3,004,421 | 10/1961 | Bowler | 70/232 |
| 3,706,211 | 12/1972 | Owen | 70/232 |
| 3,763,675 | 10/1973 | Hofmeister et al. | 70/232 |
| 3,850,392 | 11/1974 | Gassaway | 248/678 X |
| 4,065,083 | 12/1977 | Gassaway | 248/551 |

*Primary Examiner*—Wm. Carter Reynolds

*Attorney, Agent, or Firm*—Donald D. Mon

[57] ABSTRACT

A security device for rotatably mounting an article to a surface. The device includes a base with a face, a center, and a peripheral rail having a downwardly facing bearing surface. It is mountable to a surface by an adhesive member having a dimension of thickness which spaces the base from the surface. A clasp comprises two parts which can be slid together whereby to provide bearing surfaces to hold the clasp rotatably to the base member. The clasp member includes a cover to which articles can be attached, such as adhesively or by bolting. Lock means is provided for releasably engaging the two clasp parts.

13 Claims, 6 Drawing Figures

SECURITY DEVICE FOR ROTATABLY MOUNTING AN ARTICLE TO A SURFACE

This invention relates to a security device for rotatably mounting an article to a surface.

Security devices for holding articles to surfaces are generally known from Gassaway U.S. Pat. Nos. 3,850,392 and 4,065,083. As stated in these patents, the objective of a security device for office equipment, and other expensive, relatively fragile small items, is not so much to guarantee that they can not be removed from the surface to which they are attached unless a key is used, but rather to require that detachment of the equipment without using a correct key either takes so much time that a thief cannot afford the attendant risk of apprehension, or requires that the article be so damaged that it can not readily be "fenced".

The devices shown in the said Gassaway patents are quite suitable for these objectives. They find their primary use in devices which do not require rotatability when fastened to a surface, and which can justify the cost of a relatively expensive security device.

It is an object of this invention to provide a relatively inexpensive mounting means which can be attached readily to a surface and which can provide for rotatability of the article which it mounts. Such rotatability might for example be useful for mounting small computers of the size which are customarily held by the hand, CB radio microphones, and the like. Such articles may be attached by rather simple and inexpensive security devices, because their covers are usually so flimsy that to remove them from nearly any type of permanent mounting without using a proper release means such as a key will cause them to be damaged enough that they can no longer be "fenced".

A security device according to this invention includes a base member which is mounted to a surface by spacing attachment means such as adhesive means having a dimension of thickness. The base member has a downwardly-facing bearing surface. A clasp member has two parts which are slidable together, and which when slid together present a bearing surface to the downwardly facing bearing surface of the base member. Lock means is provided for holding the parts of the clasp member together and one of the clasp members includes a surface to which an article can be attached, for example by bolts or adhesives.

According to a preferred but optional feature of the invention, the thickness of the clasp member is such that its lower edge closely approaches the surface so as to make it difficult to insert pry members and the like beneath it.

The above and other features of this invention will be fully understood from the following detailed description and the accompanying drawings, in which.

Figure 1:
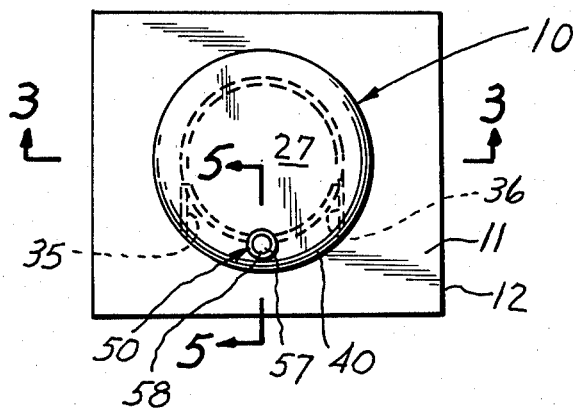
FIG. 1 is a plan view of the presently preferred embodiment of the invention attached to a surface.

In FIG. 1 a security device 10 according to the invention is shown attached to a surface 11 on a underlying member 12 which might be such as a desk top, a shelf, or even a wall.

The security device includes a base member 15 (see FIG. 3) which is a circular disc having a center 16, a face 16*a*, a peripheral circular edge 17, and a downwardly facing bearing surface 18 which is annular and adjacent to the circular edge. The disc is preferably made from a flat plate.

Figure 3:
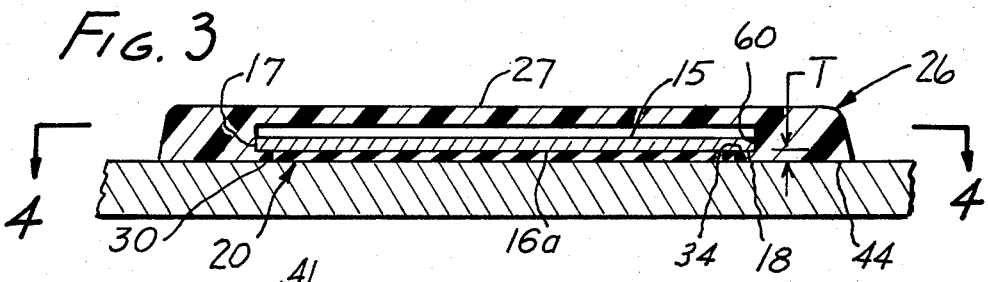
FIG. 3 is a cross-section taken at line 3—3 in FIG. 1.
Figure 5:
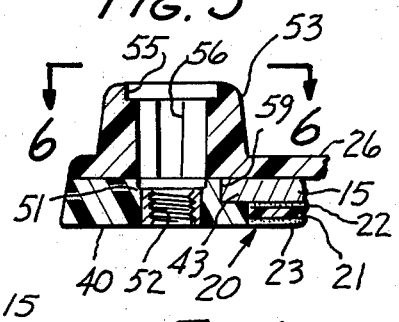
FIG. 5 is a cross-section taken at line 5—5 in FIG. 1.
Figure 6:
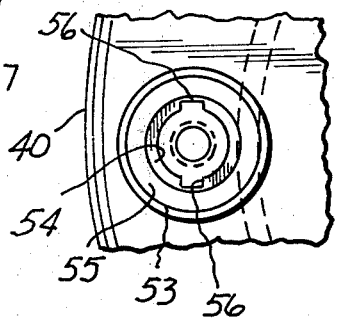
FIG. 6 is a view taken at line 6—6 in FIG. 5 with a portion removed.

Adhesive means 20 is provided to hold the plate to the surface. It preferably comprises a spacing layer such as foam 21 which is faced on its surfaces by layers 22, 23 of adhesive. The entire means 20 is called, for convenience, "adhesive means" or "spacing adhesive means", and it is adhesively attached to face 16*a* of the base member. Adhesive means 20 is also sometimes referred to as "attachment means" or "spacing attachment means". As shown in FIGS. 3 and 5 the adhesive means has a dimension of thickness which spaces the downwardly facing bearing surface 18 from the surface. The term "downwardly" is used to indicate a relationship relative to the surface rather than verticality.

Figure 2:
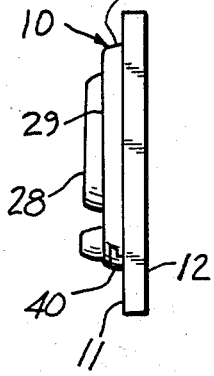
FIG. 2 is a right hand view of FIG. 1.

A clasp member 25 is formed in two parts. First part 26 includes a cover 27 which is circular and disc-like. Preferably it is imperforate. When imperforate, an article such as article 28 (FIG. 2), which might be a calculator or a microphone, can be adhesively secured to its upper surface 29. However, holes can be drilled in the cover to receive fasteners and the like to be attached to the article itself such as by threading.

Figure 4:
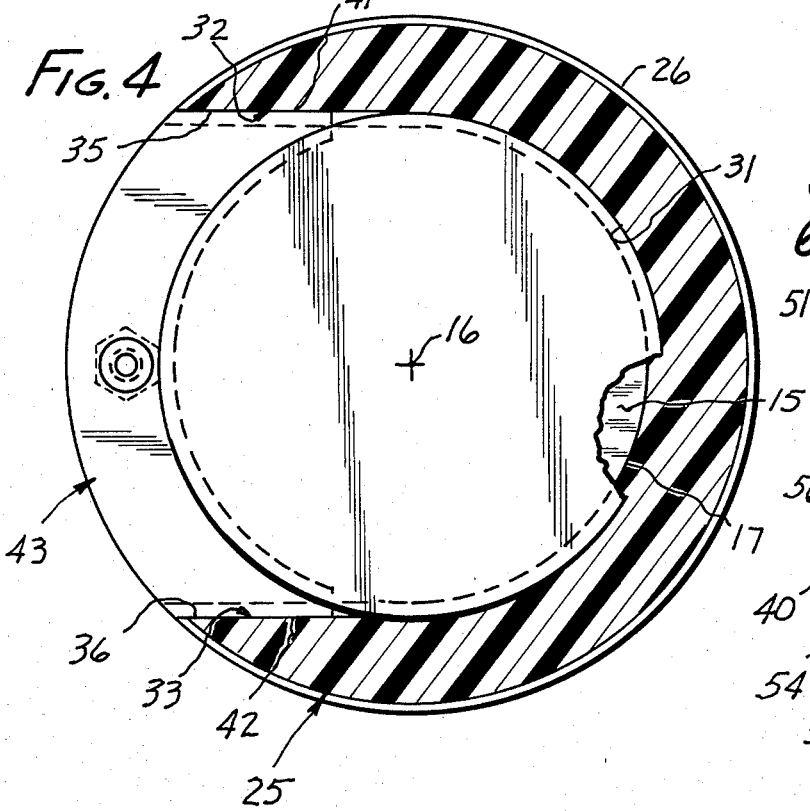
FIG. 4 is a cross-section taken at line 4—4 in FIG. 3.

The first part further includes an underlying flange 30 at the lower edge of an inside bounding wall 60, which flange includes (FIG. 4) a semi-circular bight 31 and a pair of parallel arms 32, 33. These arms extend tangentially away from the bight, and intersect the region between the bight and the cover. Within the semi-circular bight there is formed an upwardly facing bearing surface 34, which as can be seen in FIGS. 3 and 4 can be shoved under the base member so as to make sliding engagement with the downwardly facing bearing surface 18. A slot 35 is formed in arm 32, and a slot 36 is formed in arm 33.

Second part 40 is intended to be slid into the slots. For this purpose, it has a pair of parallel tongues 41, 42, and also an upwardly facing bearing surface 43 on a flange similar to flange 30 at the lower edge of an inside bounding wall 59. As best shown in FIG. 4, the second part is slid into the first part until its bearing surface comes into proper alignment with the bearing surface of the base member.

As can best be seen in FIG. 3 the dimensions of thickness T of the flanges is such that the lower face 44 of the flanges closely approaches the surface itself so as to retard the insertion of a pry bar or other means between them. Dimension T is substantially equal to the thickness of spacing adhesive means 20.

Lock means 50 includes a nut or other threaded means cast into the second part nut 51. It includes threads 52. A stud 53 rises from the first part, and includes a port 54 with a shoulder 55. It also includes lock slots 56. It will now be seen that a lock core 57 can be threaded into threads 52 and then when a key (not shown) is withdrawn from key slot 58, conventional locking pins (not shown) will enter the lock slots and prevent the lock means from being unthreaded. Even without key-lock means, this device can successfully be used by threading a threaded bolt into the threads to hold the device together. This will require enough time to unthread that a thief may reasonably be deterred, especially if some locking agent such as "Loctite" were placed in the threads, which also would require effort to overcome its locking effect. Therefore the term "lock means" includes simple fasteners, as well as more permanent attachments, such as rivets or cemented-in bolts.

It will now be seen that the device is readily assembled and disassembled, provided one has plenty of time and the key, or the patience to overcome whatever other form of lock means is used. To disassemble the article shown in FIG. 1, the key is placed in the key slot to unlock the lock by retracting the tumbler pins. It is then unthreaded from thread 52. At that time the clasp member can be disassembled by sliding the two parts away from one another. The article is then free to be taken away, of course attached to the cover.

To install the device, it is merely necessary adhesively to secure the base member to a surface and then either before or after the article is mounted to the cover to slide the parts of the clasp onto one another and around the base member. The lock is inserted and turned into the nut so that some part also bears against the shoulder 55. The key is then removed. Because the bounding surfaces of the walls 59, 60 of the first and second parts respectively are of substantially the same radius of curvature as that of the disc, the clasp member can be rotated around the center 16 and the article readily put into use.

This invention is not to be limited by the embodiment shown in the drawings and described in the description which is given by way of example and not of limitation, but only in accordance with the scope of the appended claims.

I claim:

1. A security device for rotatably mounting an article to a surface, said device comprising:

a base member having a face, a center, and a downwardly facing bearing surface around its periphery;

a clasp member comprising a first part having a cover, an inside bounding wall, and an underlying flange at an elevation below said bounding wall, which flange includes a semi-circular bight and a pair of arms, said bight including an upwardly facing bearing surface which engages said bearing surface of said base member, said arms including a pair of slots which intersect the region between the bight and the cover, and a second part having a pair of tongues which are engagable and slidable in said slots, and a curved flange having an upwardly facing bearing surface, said last named bearing surface, when said tongues are engaged in said slots, engaging said downwardly facing bearing surface of said base member;

lock means for releasably holding the two clasp parts together; and spacing attachment means fixed to said face of said base member for mounting said base member to said surface and spacing its bearing surface therefrom, whereby with the base member mounted to the surface, said clasp member parts can be slid together with the bearing surface of the base member rotatably engaged by the bearing surface of the clasp member parts, and the lock means locked to hold said clasp member parts together, an article being attachable to said cover.

2. A security device according to claim 1 in which the base member is a circular disc.

3. A security device according to claim 2 in which said attachment means includes a layer of foam.

4. A security device according to claim 1 in which the thickness of said flange is substantially equal to the thickness of said attachment means, whereby closely to approach said surface.

5. A security device according to claim 1 in which said lock means includes a nut in one of said parts, a shoulder and port in the other, and a threaded, lockable core threadable in said nut, engageable to said shoulder, and lockable to one of said parts.

6. A security device according to claim 1 in which said cover includes a surface to which an article can be mounted.

7. A security device according to claim 1 in which said cover includes a surface to which an article can be adhesively attached.

8. A security device according to claim 4 in which the base member is a circular disc.

9. A security device according to claim 8 in which said lock means includes a nut in one of said parts, a shoulder and port in the other, and a threaded, lockable core threadable in said nut, engageable to said shoulder, and lockable to one of said parts.

10. A security device according to claim 9 in which said cover includes a surface to which an article can be adhesively attached.

11. A security device according to claim 9 in which said cover includes a surface to which an article can be boltably attached.

12. A security device according to claim 1 in which said spacing attachment means has an exposed adhesive surface for attaching said base member to said surface.

13. A security device according to claim 12 in which said spacing attachment means has a second adhesive surface, by means of which it is attached to said base member.

* * * * *